US005284535A

United States Patent [19]

Ueshima et al.

[11] Patent Number: 5,284,535

[45] Date of Patent: Feb. 8, 1994

[54] METHOD OF MANUFACTURING AN AUSTENITIC STAINLESS STEEL SHEET AND A MANUFACTURING SYSTEM FOR CARRYING OUT THE SAME

[75] Inventors: Yoshiyuki Ueshima, Kawasaki; Kenichi Miyazawa; Toshiaki Mizoguchi, both of Kimitsu; Masayuki Abe, Sagamihara, all of Japan

[73] Assignee: Nippon Steel Corporation, Tokyo, Japan

[21] Appl. No.: 743,366

[22] PCT Filed: Dec. 20, 1990

[86] PCT No.: PCT/US90/01665

§ 371 Date: Aug. 19, 1991

§ 102(e) Date: Aug. 19, 1991

[87] PCT Pub. No.: WO91/09144

PCT Pub. Date: Jun. 27, 1991

[30] Foreign Application Priority Data

Dec. 20, 1989 [JP] Japan ..... 1-328261
Dec. 20, 1989 [JP] Japan ..... 1-328263

[51] Int. Cl.[5] ..... C21D 8/02

[52] U.S. Cl. ..... 148/610; 148/611; 148/542; 148/546; 164/477

[58] Field of Search ..... 148/610, 611, 542, 546; 164/477

[56] References Cited

FOREIGN PATENT DOCUMENTS

| | | | |
|---|---|---|---|
| 0247264 | 12/1987 | European Pat. Off. . | |
| 61-189846 | 8/1986 | Japan . | |
| 63-421 | 1/1988 | Japan . | |
| 63-115654 | 5/1988 | Japan . | |
| 64-11925 | 1/1989 | Japan . | |
| 3-71902 | 3/1991 | Japan | 148/542 |

OTHER PUBLICATIONS

Supplementary European Search Report EP 9190 0936.
Tetsu To Hagane, 1985—A197 A256.
J. Singh et al., Metallurgical Transaction A, "Microstructural and Microchemical Aspects of the Solid-State Decomposition of Delta Ferrite in Austenitic Stainless Steels" vol. 16 A, Aug. 1985, pp. 1363–1369.

*Primary Examiner*—Deborah Yee
*Attorney, Agent, or Firm*—Kenyon & Kenyon

[57] ABSTRACT

A method of manufacturing an austenitic stainless steel sheet having reduced minute surface concavities and convexties ropings and gloss unevenness and a manufacturing system for carrying out the same are provided. The method comprises (a) a casting process of casting a molten austenitic (γ) stainless steel into a thin cast plate by a twin-roll thin plate casting method employing a pair of cooled rolls disposed opposite to each other, (b) a cooling process of cooling the cast thin plate in a single phase state of the γ phase, (c) a cast plate in a dual phase state of the δ and γ phase or a single phase state of the δ phase and then cooling the thin cast plate to restore the single phase state of the γ phase, and (d) a cold-rolling process of cold-rolling the heat-treated thin cast plate.

6 Claims, 10 Drawing Sheets

METHOD OF MANUFACTURING AN AUSTENITIC STAINLESS STEEL SHEET AND A MANUFACTURING SYSTEM FOR CARRYING OUT THE SAME

TECHNICAL FIELD

The present invention relates to a method of manufacturing an austenitic stainless steel sheet, and more particularly, to a method of manufacturing an austenitic stainless steel sheet, including cold-rolling a cast plate having a thickness nearly equal to that of a part to be formed and prepared by a synchronous continuous casting process in the technical parlance, in which the speed of the cast plate relative to the inner surface of the mold is zero, and to a manufacturing system for carrying out the same.

BACKGROUND ART

A conventional method of manufacturing a thin stainless steel sheet employing a continuous casting process comprises casting a cast plate having a thickness of not less than 100 mm while the mold is vibrated in the casting direction, cleaning the surfaces of the cast plate, hot-rolling the cast plate into a hot strip of a thickness on the order of several millimeters by a hot strip mill consisting of roughing stands and finishing stands arranged in series, after heating the cast plate to a temperature not lower than 1000° C., descaling the hot strip, if needed, after annealing the same, cold-rolling the descaled hot strip, and finish-annealing the cold-rolled strip.

Such a conventional method has problems in that a very long hot strip mill must be used for hot-rolling the cast plate of a thickness not less than 100 mm, and a large quantity of energy must be used for the specific gravity of the cast plate and rolling the cast plate.

To solve such problems, studies have been made to develop an improved continuous casting process capable of producing a cast plate having a thickness equal to or nearly equal to that of the hot strip. Synchronous continuous casting processes of a twin-roll system and a twin-belt system, in which the speed of the cast plate relative to the inner surface of the mold is zero, are reported in papers inserted in the special edition of "Tetsu to Hagane", '85-A197 -'85-A256.

In a first method employing the continuous casting process of a twin-roll system, a thin cast plate of a thickness in the range of 0.5 to 10 mm is produced. Then, a sheet of a desired thickness is produced only by cold-rolling after subjecting the cast plate to an annealing process and a pickling process for descaling.

In a second method employing the continuous casting process of a twin-roll system, a thin cast plate of a thickness in the range of 0.5 to 10 mm is produced. Then, the cast plate is hot-rolled to produce a hot-rolled strip, the hot-rolled strip is descaled by pickling, and then the descaled strip is cold-rolled in a sheet of a desired thickness.

The cast plate produced in accordance with the above prior methods has a coarse crystal grain microstructure and, then to produce a cold-rolled sheet of a satisfactory surface quality by rolling the cast plate, the draft of the cold-rolling process in the first method must be considerably large, and the second method requires that the cast plate be hot-rolled before the cold-rolling process. Accordingly, these previously proposed methods have problems a long processing time and a significant increase of the cost of the sheet.

DISCLOSURE OF THE INVENTION

Accordingly, an object of the present invention is to provide a method of manufacturing an austenitic stainless steel sheet having insignificant minute surface concavities and convexties, insignificant roping, and a negligible uneven gloss.

According to the present invention, the foregoing problems can be solved by a method of manufacturing an austenitic stainless steel sheet comprising:

(a) a process of casting a molten austenitic ($\gamma$) stainless steel by a thin plate producing process of a twin-roll system employing a pair of opposite cooling rolls to produce a thin cast plate, (b) a cooling process of cooling the thin cast plate to form a $\gamma$-phase solid solution, (c) a heat-treating process comprising heating the thin cast plate to maintain the thin cast plate in the $\delta$ and $\gamma$ dual phase or the $\delta$ phase, and cooling the heated thin cast plate to change the phase of the cast plate from the $\delta$ and $\gamma$ dual phase or the $\delta$ phase into the $\gamma$ phase, and (d) a rolling process of cold-rolling the heat treated thin cast plate; and by a manufacturing system for carrying out the same method.

Preferably, the method in accordance with the present invention includes a plastic working process before heating the thin cast plate to a temperature region of the $\delta$ and $\gamma$ dual phase or the $\delta$ phase, and the manufacturing system includes plastic working means. Furthermore, preferably, the method in accordance with the present invention repeats at least twice a cycle of heating the thin cast plate to maintain the thin cast plate in the $\delta$ and $\gamma$ dual phase or the $\delta$ phase and cooling the same to restore the $\gamma$ phase, because the repetition of the cycle further refines the microstructure of the thin cast plate and further improves the surface properties of the thin cast plate. The thin cast plate casting machine of a twin-roll system has no restriction on the direction of casting the cast plate, the respective diameters of the two rolls of the casting machine need not necessarily be the same. Namely, the casting machine may be a vertical twin-roll casting machine, an inclined twin-roll casting machine or a different diameter twin-roll casting machine.

FIG. 14 is a Fe—Cr—Ni three-component phase diagram (30% Fe vertical section) of assistance in explaining the phase transformation of SUS304 relating to the present invention.

The method in accordance with the present invention performs at least once the cycle of heating a thin cast plate of austenitic ($\gamma$) stainless steel produced by a continuous casting process of a twin-roll system for maintaining a $\delta$ and $\gamma$ dual phase state Y or a $\delta$ single phase state Z and cooling the thin cast plate for restoring a $\gamma$ phase state X to cause a $\delta/\gamma$ phase transformation, and subjects the thin cast plate to plastic working, such as rolling, to refine the metal crystal grains by the phase transformation and work recrystallization promoting action of the plastic working.

Thus, a rolled sheet having improved surface properties including roping and gloss unevenness can be produced by subjecting a work having crystal grains refined by the heat treatment and the plastic working according to the present invention to a final rolling process.

The present invention is applied effectively to manufacturing austenitic stainless steel sheets, such as SUS304 sheets, SUS316 sheets, SUS303 sheets and the like.

As is well known, the $\alpha$ grains of simple steels are refined through the $\gamma$ (austenite)/$\alpha$ (ferrite) transformation, which is explained, for example, in Unexamined Japanese Patent Publication No. Sho 63-115654. Such a fact applies only to simple steels and to a low temperature range of 700° C. to 950° C. The novelty of the present invention is found in dealing with stainless steels and the utilization of the $\delta/\gamma$ transformation at a temperature in a high temperature range of 1000° C. to 1400° C. as shown in FIG. 14.

BEST MODE OF CARRYING OUT THE INVENTION

A method of manufacturing an austenitic stainless steel sheet in a preferred embodiment according to the present invention will be described hereinafter in comparison with conventional methods with reference to the accompanying drawings.

Small sample pieces of 18Cr-10Ni stainless steel of 3 mm in diameter and 10 mm in length were subjected to heat treatment processes of different conditions, respectively, to confirm the effects of heat-treating conditions on average $\gamma$-grain size and roping height. Roping height was measured by a surface roughness tester after cold-rolling the sample pieces at a reduction of area of 50%.

The results of the reference sample which was not given a heat treatment, and the samples which were heat treated i.e., A, B and C, e.g., average $\gamma$-grain size and roping height, are respectively shown in Table 1.

Figure 1:
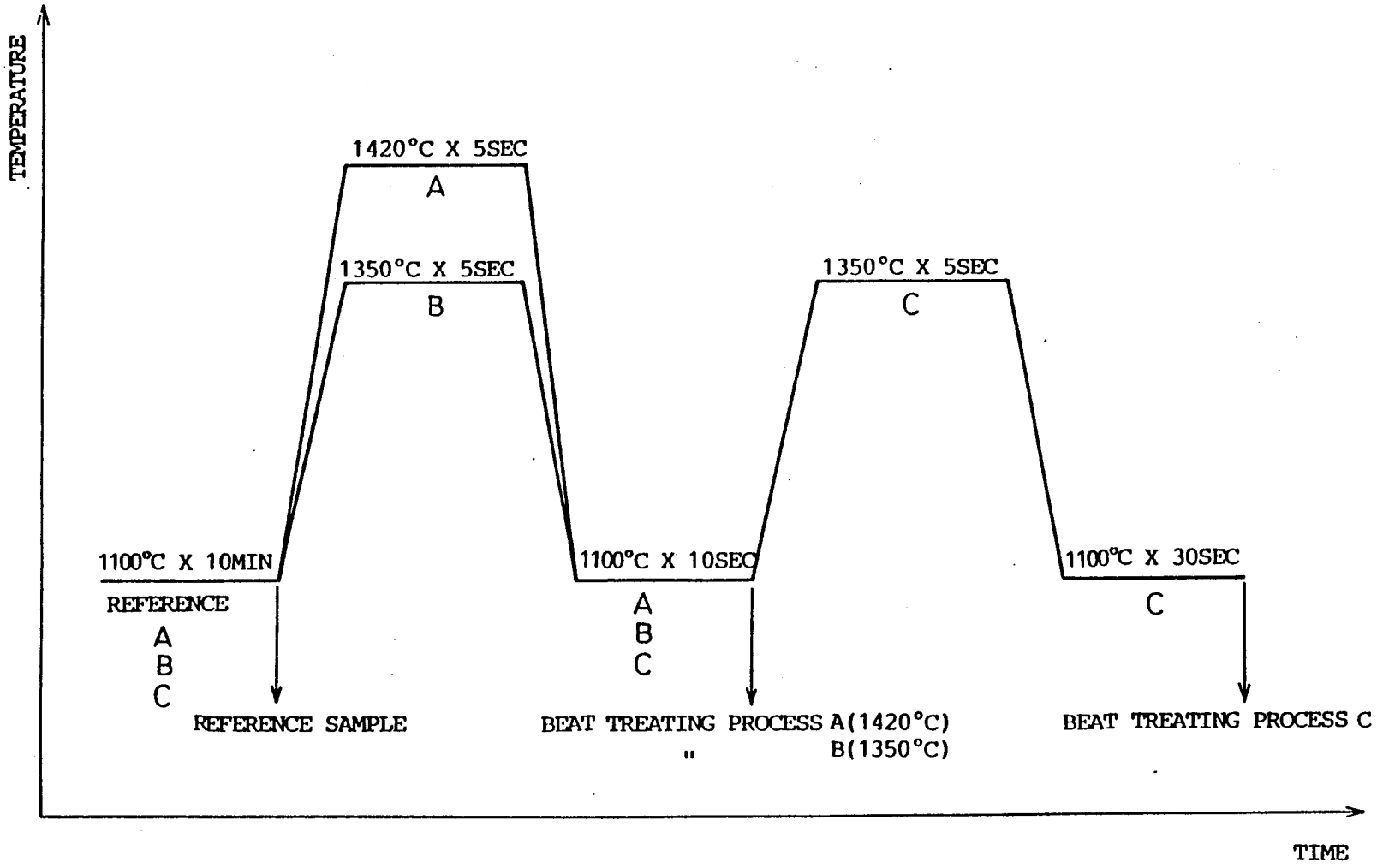
FIG. 1 is heat-treating process diagrams for heat-treated processes A, B and C, and a reference sample.
Figure 2:
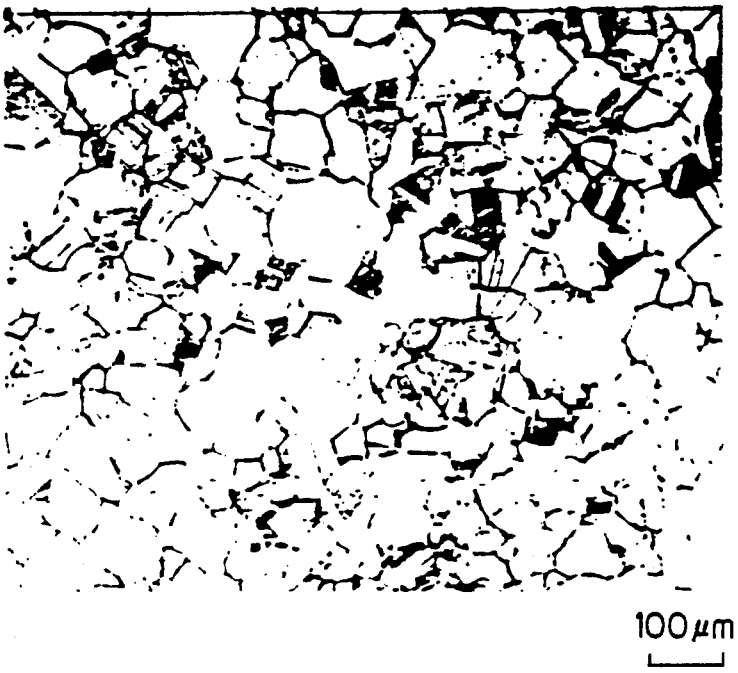
FIGS. 2, 3, 4 and 5 are metallographic photograph of a reference sample processed by a conventional method, and heat-treated processes A, B and C, respectively.

A heat treating process diagrams of the heat treated samples A, B, C and the reference sample are shown in FIG. 1.

TABLE 1

| | Heat treating conditions, average $\gamma$-gain size and roping height | | |
|---|---|---|---|
| | Heat-treating conditions | Average $\gamma$-grain size ($\mu$m) | Roping height ($\mu$m) |
| Reference sample | — | 71 | 0.82 |
| Heat-treating process A | 1420° C. × 5 sec | 24 | 0.08 |
| Heat-treating process B | 1350° C. × 5 sec | 60 | 0.20 |
| Heat-treating process C | 1350° C. × 5 sec and 1100° C. × 30 sec × 2 | 32 | 0.12 |

All the sample pieces were held at 1100° C. for ten minutes for grain size adjustment to adjust the respective average grain sizes of the samples to the same value before subjecting the samples to the test heat-treating processes.

FIGS. 2, 3, 4 and 5 are metallographic photographs of the reference sample (conventional process), the samples subjected to the heat-treating processes A, B and C, respectively. As is obvious from FIGS. 2, 3, 4 and 5, the crystal grains of the samples obtained by the heat-treating processes A, B and C are finer than those of the reference sample. The grain sizes decrease in the order of the heat-treating process A, C and B.

Figure 6:
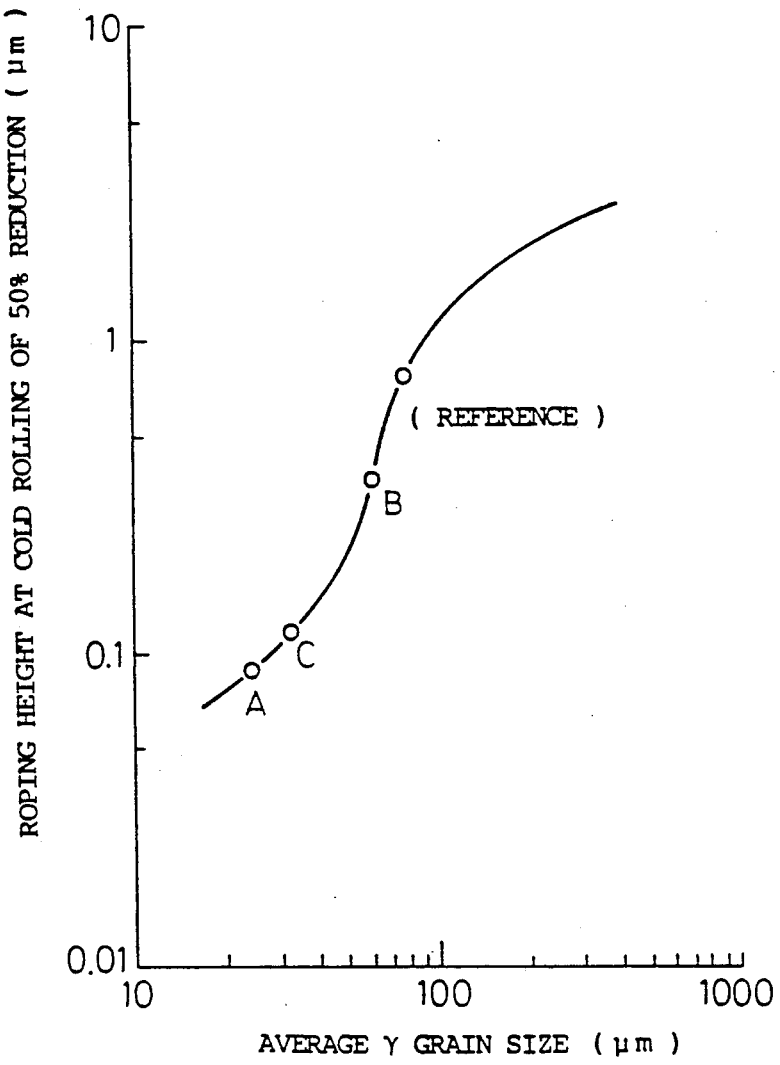
FIG. 6 is a graph showing the relation between average $\gamma$-grain size ($\mu$m) and roping height ($\mu$m) in cold-rolled samples cold-rolled after different heat treatment processes.

As is obvious from FIG. 6 showing the relation between the average $\gamma$-grain size ($\mu$m) and the roping height ($\mu$m) of the heat-treated samples after 50% cold rolling, the reduction in the average $\gamma$-grain size improves roping, namely, reduces the roping height.

A preferred embodiment according to the present invention will be described hereinafter.

Figure 7:
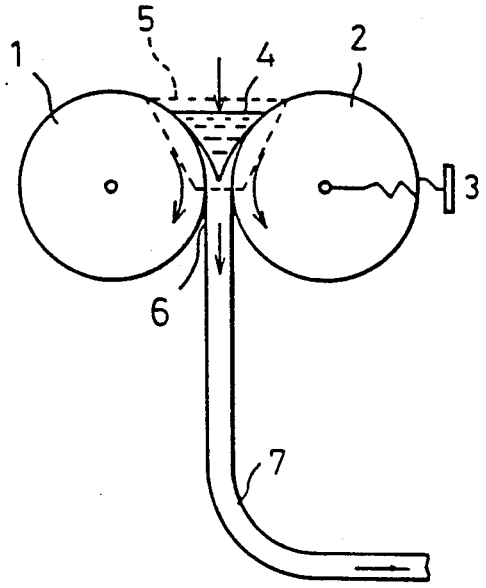
FIG. 7 is a schematic sectional view of an essential portion of a twin-roll casting machine employed in carrying out a method embodying the present invention.

FIG. 7 is a typical sectional view of a twin-roll casting machine employed in carrying out the method embodying the present invention.

Figure 8:
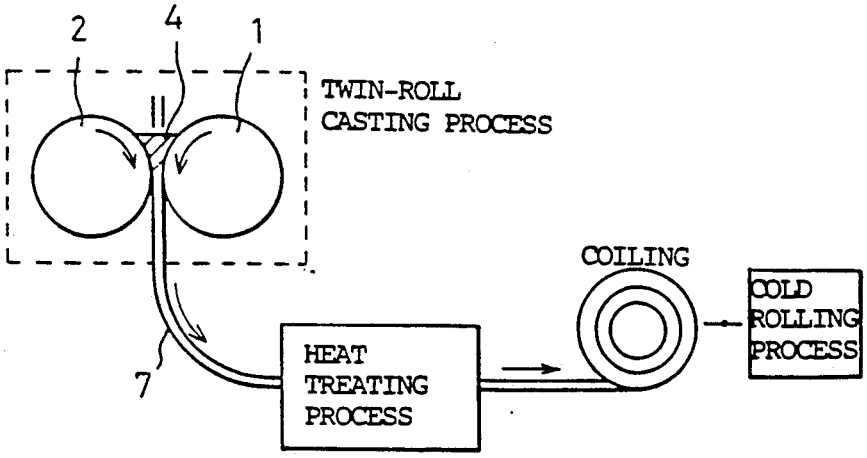
FIG. 8 is a block diagram typically showing a manufacturing system for carrying out the present invention.

FIG. 8 is a typical view of a manufacturing system in accordance with the present invention.

Referring to FIG. 7, two rolls (1 and 2) disposed adjacent to each other comprise from water-cooled copper alloy having a diameter of 30 cm and length of 10 cm. A rotative driving unit, not shown, including an electric motor and a cast plate pressing unit 3 containing springs are set against the rolls 1 and 2. The rotating speed of the rolls 1 and 2, and the roll gap between the rolls 1 and 2 are controlled properly to produce a thin cast plate 7 of a desired thickness. Side dams 5 formed of a refractory material are pressed against the opposite ends of the rolls 1 and 2 to form a molten steel pool 4. The molten material solidifies in a solidification shell 6. As shown in FIG. 8, the cast plate 7 produced by the twin rolls system is coiled after heat treatment, and the coil is subjected to cold-rolling.

Figure 9:
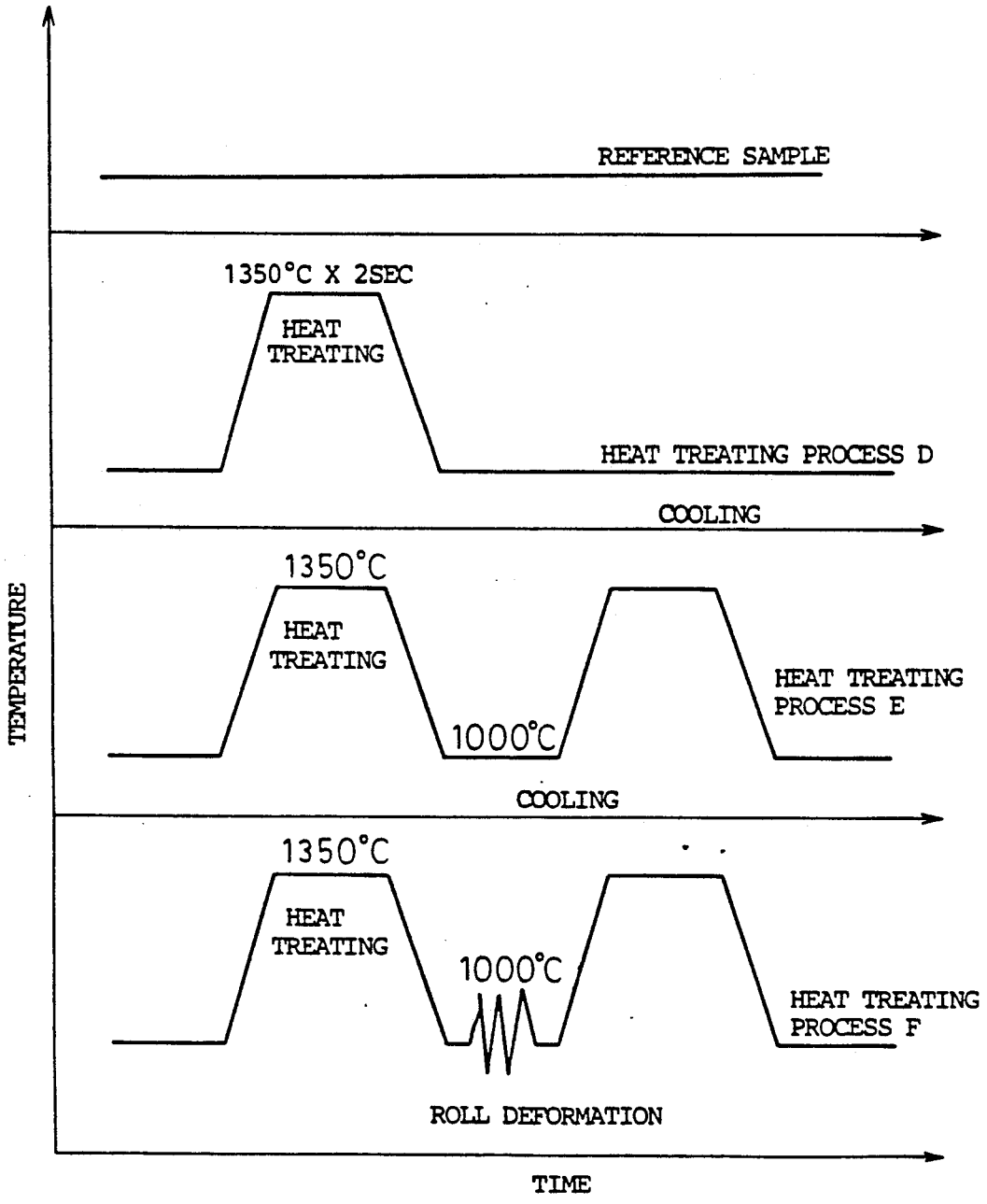
FIG. 9 is heat-treating process diagrams respectively for a reference sample, and heat-treated process D, E and F.

A thin cast plate of 18Cr-8Ni austenitic stainless steel (SUS304) having a thickness of 10 mm and a width of 100 mm was produced by the twin-roll casting machine at a casting temperature of 1500° C. and at a rotating speed of the rolls of 1.4 m/sec. Table 2 shows the properties (average $\gamma$-grain size, roping height, gloss unevenness) of a reference sample not heat treated and samples produced by a heat-treating process D, E and F. Heat-treating process diagrams for the reference sample and the heat-treated processes D, E and F are shown in FIG. 9.

TABLE 2

| | Heat treating condition, average γ-gain size and roping height of cold plate | | | |
|---|---|---|---|---|
| | Heat-treating conditions | Average γ-grain size (μm) | Roping height (μm) | Gloss unevenness class *1 |
| Reference | — | 70 | 1.2 | 5 |
| Heat treating process D | 1350° C. or above × 2 sec | 40 | 0.15 | 2 |
| Heat treating process E | 1350° C. or above × 2 sec × 2 | 35 | 0.13 | 1 |
| Heat-treating process F | 1350° C. or above × 2 sec + cooling + bending + 1350° C. or above × 2 sec + natural cooling | 22 | 0.10 | 1 |

Note *1:
Class 1: Excellent,
Class 2: Good,
Class 5: Bad

Figure 10:
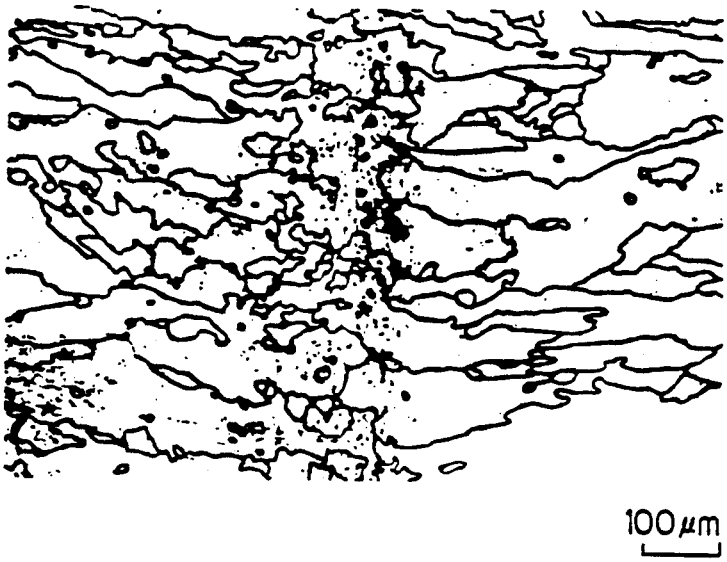
FIG. 10 and 11 are metallographic photographs of the reference material processed by the conventional heat treatment process and the material processed by the heat treatment process D, respectively.
Figure 11:
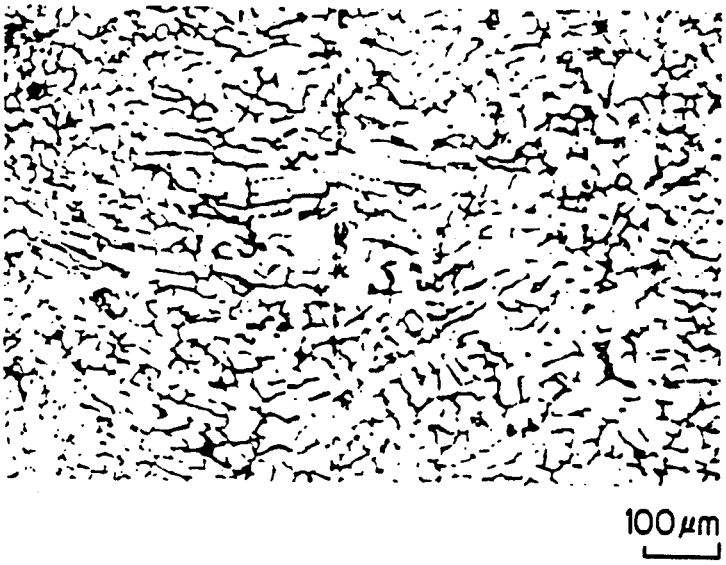

FIG. 10 and 11 are metallographic photographs of the reference sample and the sample subjected to a heat-treating process D, respectively. As is obvious from FIGS. 10 and 11, the crystal grains of the heat-treating process D are smaller than those of the reference sample, which proves the grain refining effect (effect on the reduction of the average γ-grain size) of the heat treatment, and the roping height and gloss unevenness of the heat-treated samples are improved remarkably as compared with those of the reference sample.

Figure 3:
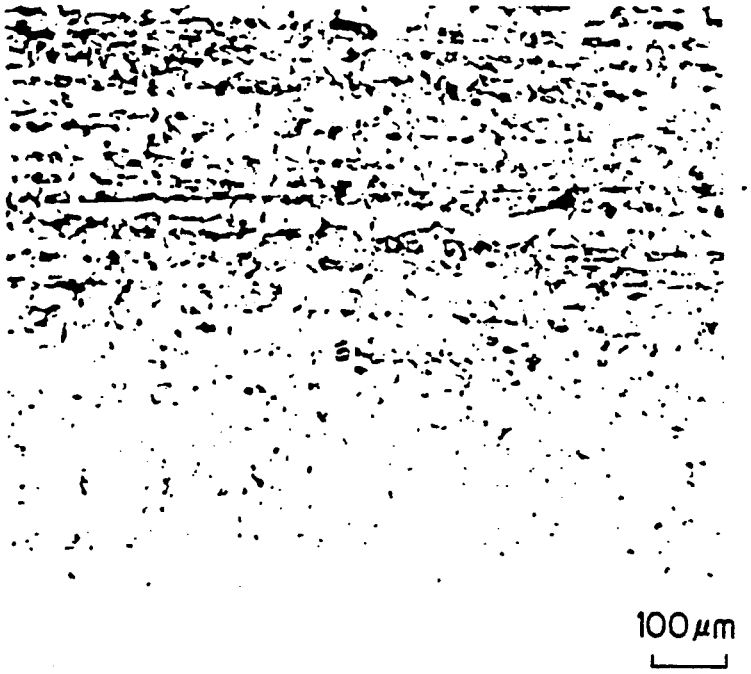
Figure 4:
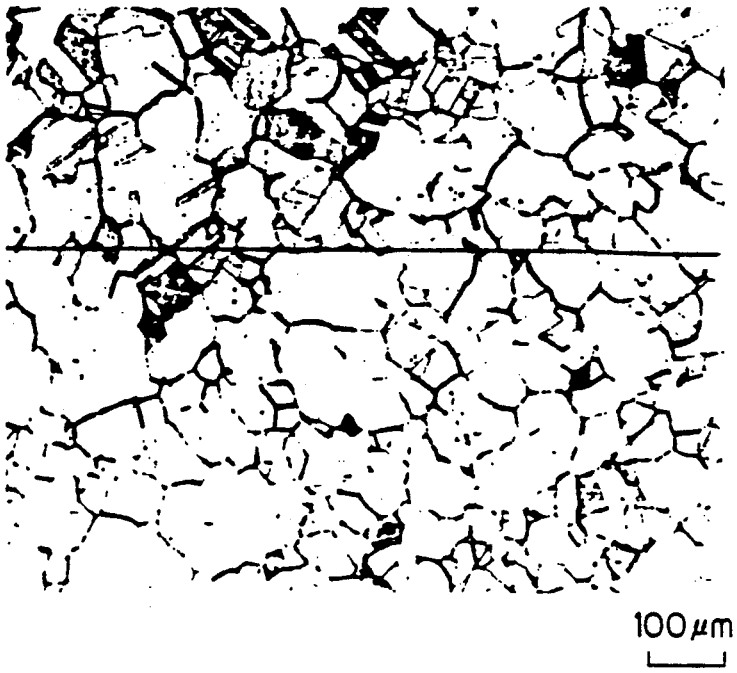
Figure 5:
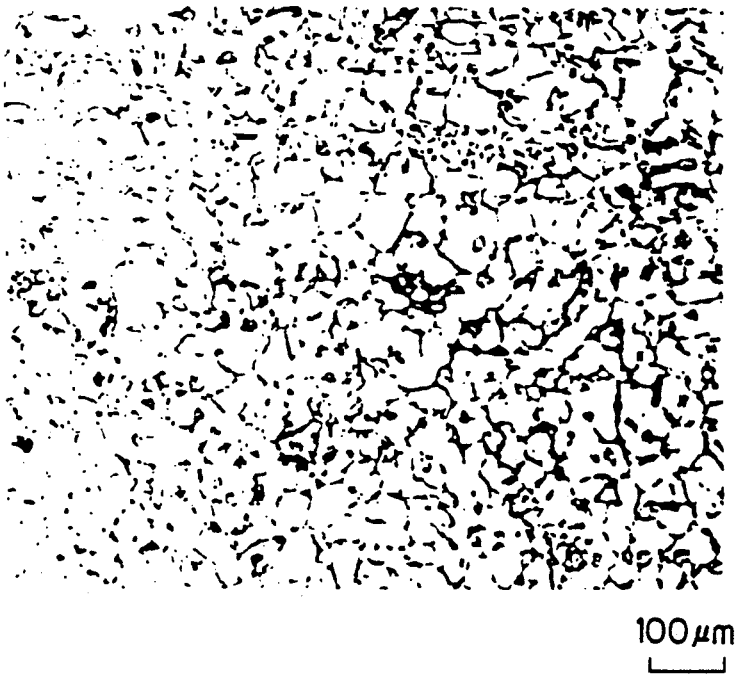
Figure 12:
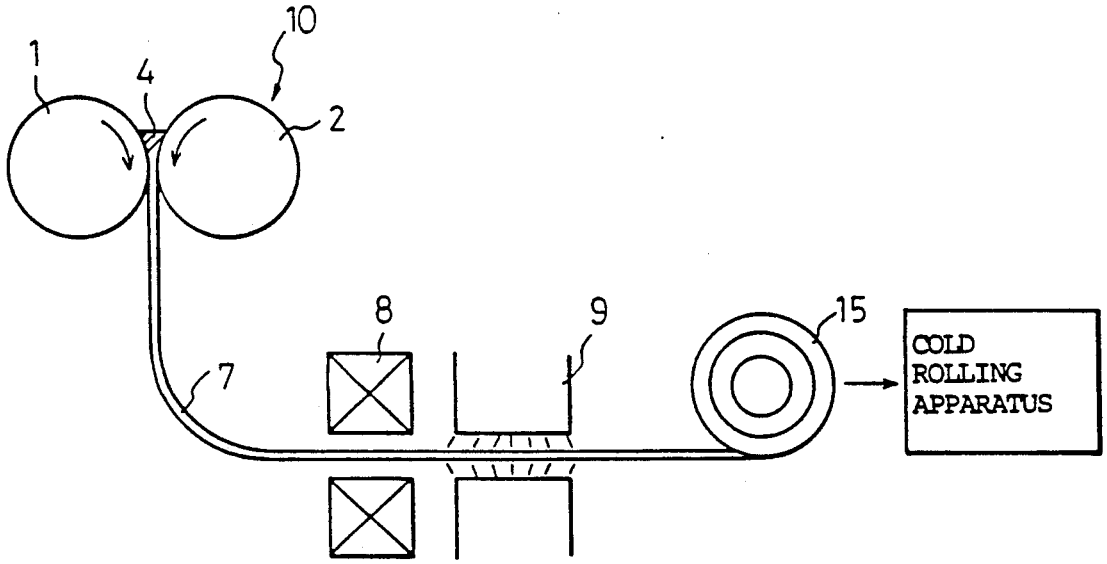
FIGS. 12 and 13 are schematic views of manufacturing systems for carrying out methods embodying the present invention for the heat treatment processes D and F, respectively.
Figure 13:
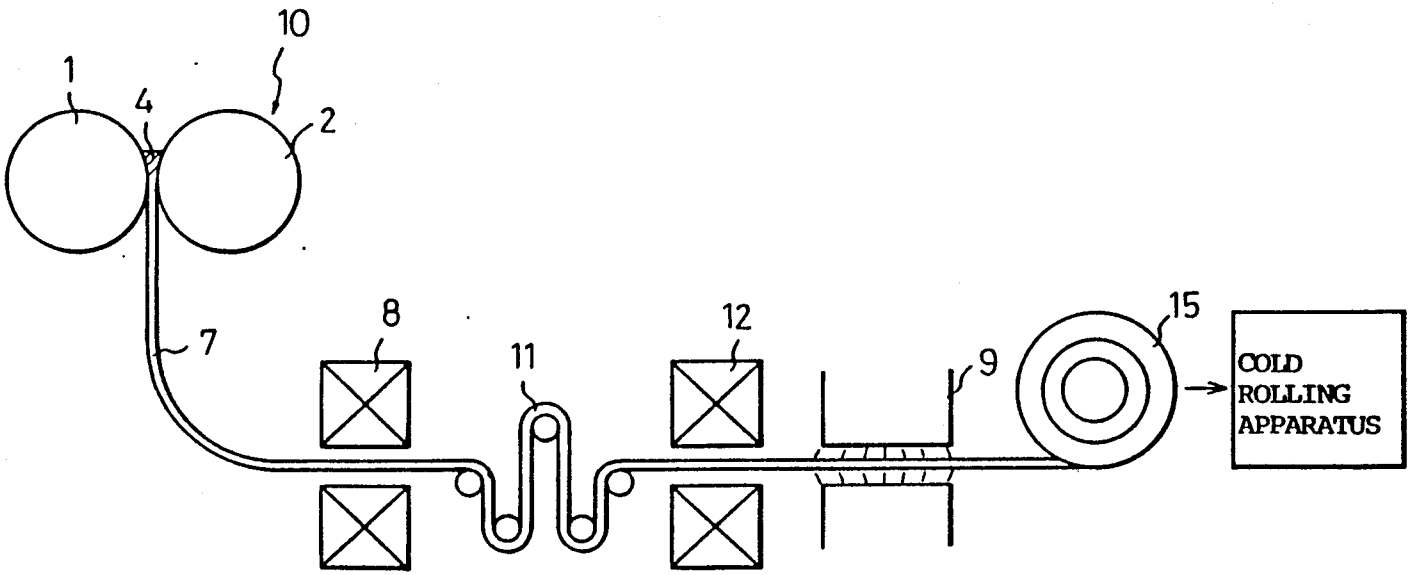
Figure 14:
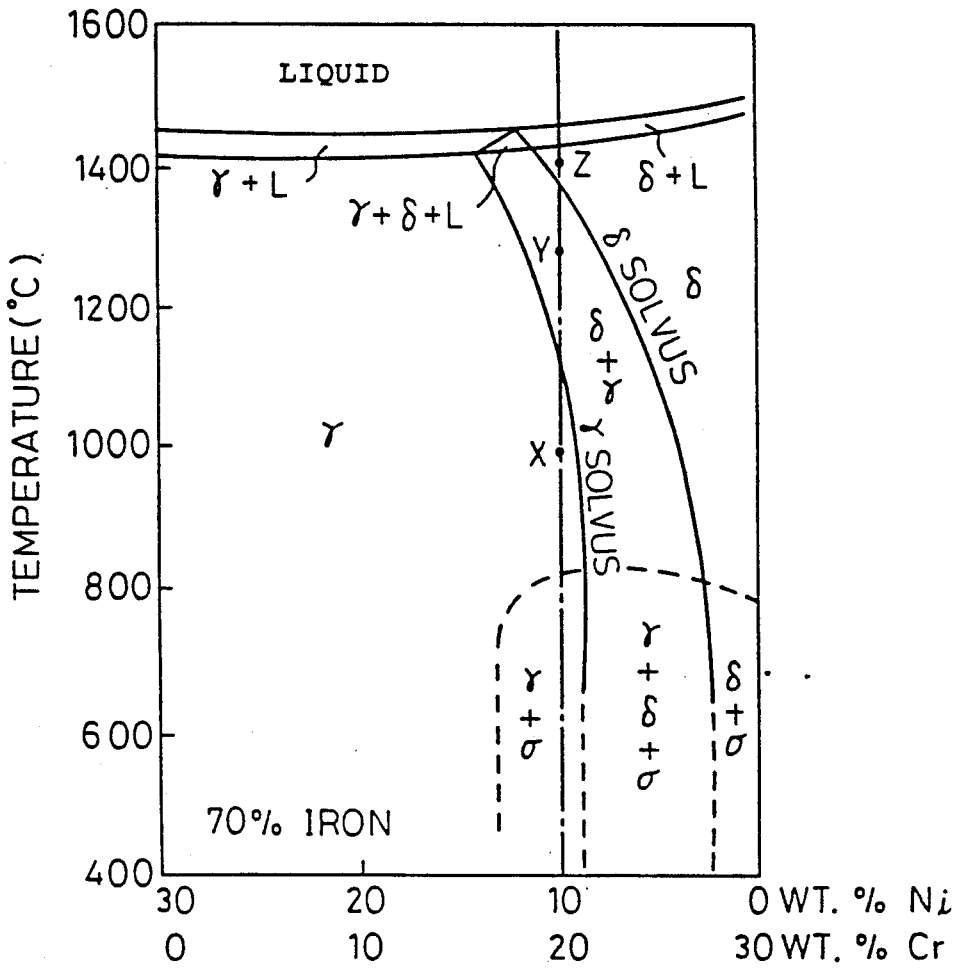
FIG. 14 is a Fe—Cr—Ni three-component phase diagram (30% Fe vertical sectional view) (Source: J. Singh et al., Met. Trans. A, 16A (1985), p. 1363) of assistance in explaining the phase transformation ($\delta/\gamma$ transformation) of SUS304 relating to the present invention.

More concretely, as shown in FIG. 12, the heat-treating process D is carried out by heating the thin cast plate 7 cast by the twin-roll casting machine by a heating unit 8 disposed directly below the rolls, cooling the thin cast plate 7 by a cooling unit 9, coiling the thin cast plate 7 by a coiling machine 10, and subjecting the thin cast plate 7 to a cold-rolling mill. The heating unit in this embodiment is a high-frequency heating apparatus or a burner and is controlled to heat thin cast plate 7 at a temperature in the range of 1200° C. to 1450° C. The cooling unit 9 is a forced gas-cooling apparatus for cooling the thin cast plate 7 to a temperature below 1200° C. The heat-treating process E was carried out by a manufacturing system comprising a series arrangement of two sets each of the heating unit 8 and the cooling unit 9. The heat-treating process F was carried out, as shown in FIG. 3 by a manufacturing system provided with a light working unit 11 carried out cooling and working at the same time, a heating unit 12 and a cooling unit 9, which are arranged after the heating unit 8 of the above example.

CAPABILITY OF EXPLOITATION IN INDUSTRY

As apparent from the foregoing description, the present invention employing a twin-roll casting machine is capable of manufacturing a cold-rolled sheet having greatly reduced minute surface concavities and convexties, ropings and gloss unevenness, and fine surface quality superior to that of cold-rolled sheets manufactured by the convention method.

We claim:

1. A method of manufacturing an austenitic stainless steel sheet comprising:
   (a) a casting process of casting a molten austenitic (γ) stainless steel into a thin cast plate by a twin-roll thin plate casting method employing a pair of cooled rolls;
   (b) a cooling process of cooling the thin cast plate in a single-phase state of the γ phase;
   (c) a heat-treating process of heating and holding the thin cast plate in a dual phase state of the δ and γ phase or a single phase state of the δ phase and then cooling the thin cast plate to restore the single phase state of the γ phase; and
   (d) a cold-rolling process of cold-rolling the thus heat-treated thin cast plate.

2. A method according to claim 1, wherein the heat-treating process of heating and holding the thin cast plate in a dual phase state of the δ and γ phase or a single phase state of the δ phase and then cooling the thin cast plate to restore the single phase state of the γ phase is repeated at least twice.

3. A method according to claim 1 or 2, wherein the thin cast plate is subjected to a plastic working for rolling or bending before stage of the heat-treating process.

4. An austenitic stainless steel sheet manufacturing system comprising:
   (a) a twin-roll casting machine for casting a molten austenitic (γ) stainless steel, provided with a pair of cooled rolls disposed opposite to each other;
   (b) a heating unit for heating a thin cast plate cast by the twin-roll casting machine said heating unit including means for heating the thin cast plate to a temperature in the range of 1200° C. to 1450° C.; and
   (c) a cooling unit for cooling the thin cast plate heated by the heating unit to a temperature not higher than 1200° C.;

wherein at least one set of the heating unit and the cooling unit is arranged alternately.

5. An austenitic stainless steel sheet manufacturing system according to claim 4, further comprising a plastic working unit for the plastic working of the thin cast plate before heating the thin cast plate by the heating unit.

6. A method according to claim 1 which further includes said heat-treating process comprising heating the thin cast plate to a temperature in the range of 1200° C. to 1450° C.

* * * * *

UNITED STATES PATENT AND TRADEMARK OFFICE

CERTIFICATE OF CORRECTION

PATENT NO. : 5,284,535

DATED : February 8, 1994

INVENTOR(S) : Yoshiyuki UESHIMA, et al.

It is certified that error appears in the above-indentified patent and that said Letters Patent is hereby corrected as shown below:

ABSTRACT, line 10, between "a" and "cast" insert --heat-treating process of heating and holding the thin--.

Column 2, line 1, between "problems" and "a" insert --of--.

Column 2, line 8, change "convexties" to --convexities--.

Column 4, line 3, delete "A" and change "heat" to --Heat--.

Column 4, linw 47, change "comprise from" to --are comprised of--.

Column 5, line 57, change "carried" to --carrying--.

Column 6, line 10, change "convention" to --conventional--.

UNITED STATES PATENT AND TRADEMARK OFFICE

CERTIFICATE OF CORRECTION

PATENT NO. : 5,284,535

DATED : February 8, 1994

INVENTOR(S) : Yoshiyuki UESHIMA, et al.

It is certified that error appears in the above-identified patent and that said Letters Patent is hereby corrected as shown below:

Column 6, line 35, between "before" and "stage" insert --the--.

Column 6, line 42, after "machine" insert a comma.

Signed and Sealed this

Sixth Day of September, 1994

*Attest:*

*Attesting Officer*

Bruce Lehman

BRUCE LEHMAN

*Commissioner of Patents and Trademarks*